US005421050A

United States Patent [19]

Laganas

[11] Patent Number: 5,421,050

[45] Date of Patent: Jun. 6, 1995

[54] SHOE CONSTRUCTION METHOD

[76] Inventor: Arthur Laganas, 176 Farley Rd., Hollis, N.H. 03049

[21] Appl. No.: 143,927

[22] Filed: Oct. 27, 1993

[51] Int. Cl.[6] ..... A43B 10/00; A43B 9/12

[52] U.S. Cl. ..... 12/142 T; 12/142 RS; 36/19.5

[58] Field of Search ..... 12/142 RS, 142 T, 142 P, 12/142 R, 142 C, 142 F, 53.5, 145; 36/12, 14, 18, 19 R, 19.5

[56] References Cited

U.S. PATENT DOCUMENTS

| | | | |
|---|---|---|---|
| 2,446,286 | 8/1948 | Kamborian | 36/19.5 |
| 2,559,609 | 7/1951 | Foust | 36/19.5 |
| 4,505,055 | 3/1985 | Bergmans | 36/12 |
| 4,662,018 | 5/1987 | Autry | 12/142 RS |
| 4,964,229 | 10/1990 | Laberee | 36/93 |
| 5,146,697 | 9/1992 | Weiss | 36/12 |

FOREIGN PATENT DOCUMENTS

| | | | |
|---|---|---|---|
| 180043 | 12/1935 | Switzerland | 36/12 |

*Primary Examiner*—Steven N. Meyers
*Attorney, Agent, or Firm*—William B. Ritchie

[57] ABSTRACT

A novel method of footwear construction. A specially designed outer sole with a lip is used. It insures accurate positioning between upper and shoe linings. After the upper is complete, a sock lining is attached to a leather lining by stitching the edges of the linings to the edge of the insole. The insole is made of soft leather or soft flexible fabric. The next step is uniting the linings with the upper. Then, the upper of the shoe is assembled onto the last by inserting the last into the upper which now is completely closed by the linings only. Only the lower edge of the upper (about 1 inch) is floating loose. The fourth step is to cement the sock lining, which is attached to the upper via the vamp and quarter linings, to the specially designed sole. With the last in place, the fifth step is to cement the lower edge of the upper that was left free to the recessed lip of the sole. After this attachment has been completed, the shoe assembly is dropped into a pressure device to further set the cement bonds. After the shoe has been removed from pressure, the last is removed. As an optional final step, the cement bond attaching the previous free edge of the upper to the sole can be side-wall stitched, adding strength to the fastening. The resulting shoe is extremely lightweight, flexible, yet possesses the uniformity of shape and comfortable fit of a lasted shoe.

4 Claims, 2 Drawing Sheets

SHOE CONSTRUCTION METHOD

BACKGROUND OF THE INVENTION 1. Field of the Invention

The invention relates to a process for the manufacturing of foot apparel. 2. Description of the Related Art In modern shoe manufacturing, each step in production is performed by a separate machine. Recent improvements in production techniques have included the use of conveyor lines to speed movement of shoes from one machine to the next, and the development of new processes which reduce the time a shoe is on the last—a foot shaped form used in making the shoe—permitting quicker re-use of the last.

The four major construction methods are the GOODYEAR welt, the cement shoe technique, the injection-molded-sole technique, and the vulcanized-sole technique. Production methods vary according to the different types of shoe construction, but the basic steps are the same for all types.

The first step involves cutting the individual parts which form the leather uppers, whereby they are subsequently stitched into a completed upper shoe. The second step is to fit the insole to the exact size and shape of the last. The insole is then reinforced with cement and additional pieces of material, often canvas, to provided strength and rigidity before being tacked to the last. Third, the upper is pulled over the last and a series of operations are performed by lasting machines so as to smooth and shape the materials to the exact shape of the finished shoe. The fourth step consists of a sewing operation (often this consists of cementing rather than sewing) that unites the upper, insole and a welt to which the outer sole will be sewn or cemented. Finally, the upper, insole and sole are stitched or cemented together. The only remaining steps are those involved in finishing, such as dying, staining and polishing.

The problem associated with methods such as those described above are that they create a very rigid, stiff, often heavy, uniformly shaped shoe. Furthermore, such processes require the use of expensive lasting machines and skilled operators to smooth the shoe into its final shape. A process that provides a method for manufacturing lightweight, comfortable shoes, without the use of expensive lasting machines, is not found in the prior art.

SUMMARY OF THE INVENTION

It is the object of the invention to manufacture cost effective comfortable footwear that does not require expensive lasting and manufacturing equipment.

It is a further objective to provide a comfort feature by incorporating stitching constructions associated with footwear such as a comfort slipper, but still provide material required for outdoor footwear.

The invention is a process for manufacturing a comfortable, light weight, cost effective foot wear. The method requires a specially designed outersole with a lip that will insure accurate positioning between upper (vamp and quarter) and shoe linings (vamp and quarter linings). After the cut and stitched upper is complete, the first step of the novel process involves attaching a sock lining to a leather lining. This is accomplished by stitching the edges of the linings to edge of insole. The insole is made of soft leather or soft flexible fabric. The next step involves assembling the upper of the shoe onto the last by inserting the last into the upper which now is completely closed by the linings only. Only the lower edge of the upper (about 1 inch) is floating loose.

The fourth step is to cement the sock lining, which is attached to the upper via the vamp and quarter linings, to the specially designed sole mentioned above. While the last is still in place, the fifth step is to cement the lower edge of the upper that was left free to the recessed lip of the sole. After this attachment has been completed, the shoe assembly is dropped into a pressure device to further set the cement bonds. After the shoe has been removed from pressure, the last is removed. As an optional final step, the cement bond attaching the previous free edge of the upper and the inset of the sole can be side-wall stitched to add strength to the fastening.

DETAILED DESCRIPTION OF THE INVENTION

Figure 1:
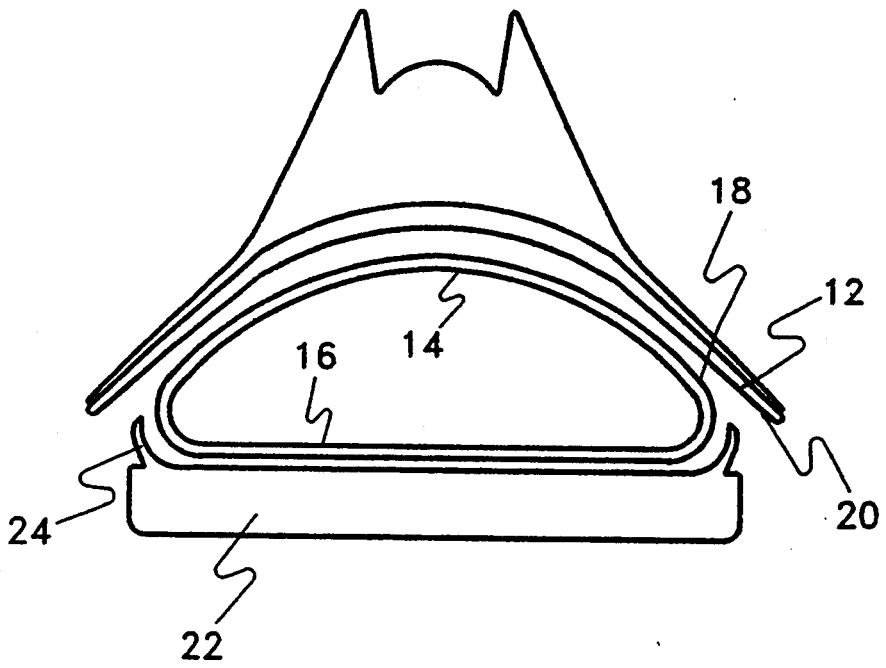
FIG. 1 illustrates a front cross-sectional view of the invention prior to the attachment of the upper's edge to the corresponding recessed lip in the sole.
Figure 2:
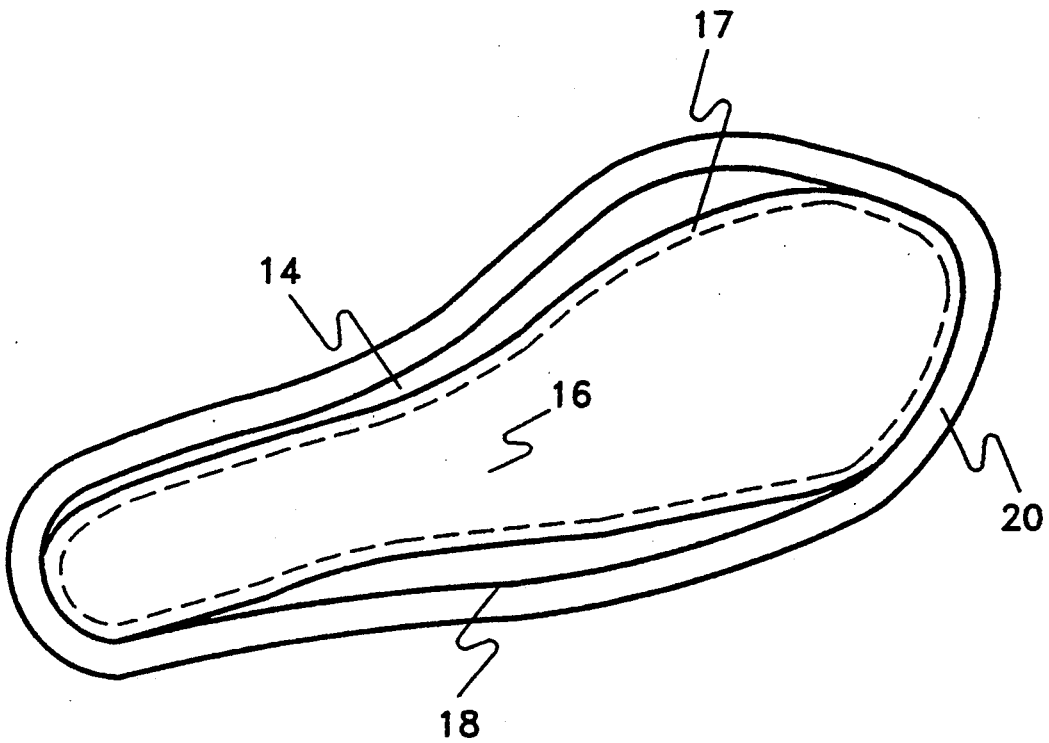
FIG. 2 illustrates a bottom view of the completed upper, thereby showing the bottom of the sock lining which is to be cemented to the sole.
Figure 3:
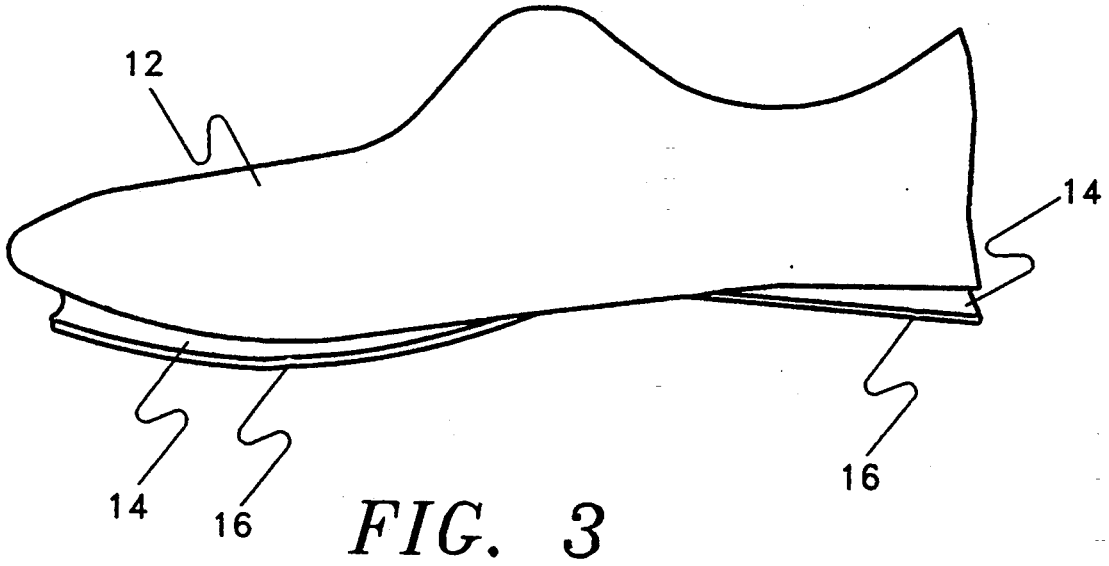
FIG. 3 illustrates a side view of the upper and the attached sock lining.
Figure 4:
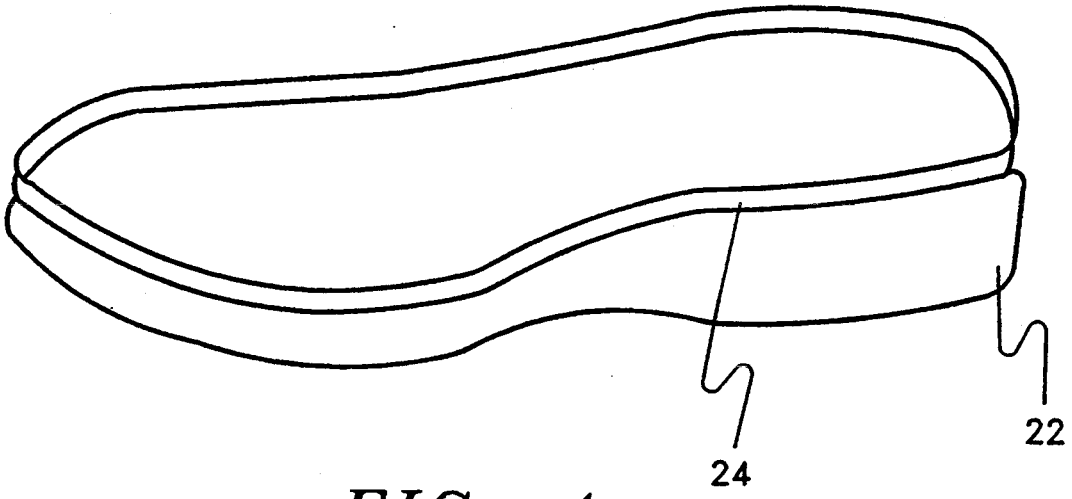
FIG. 4 is an isometeric view of the molded sole.

FIG. 1 illustrates a front cross-sectional view of the invention prior to the attachment of the upper's edge 20 the corresponding recessed lip 24 in the sole. The first step is to assemble the various parts including upper 12, with leather being the preferred material. However, synthetic materials that are known and used in shoe construction could also be used. Next, leather lining 14 which comprises vamp and quarter linings is connected to sock lining 16. Preferably, sock lining 16 is stitched to lining 14 along line 17 as shown in FIG. 2, however, gluing could be substituted. Lining 14 and sock lining 16 are connected at the top and bottom but open at the very bottom. At this stage, if using present methods, such as the "California" process, upper 12 and lining 14 would be stitched together. However, using the inventor's method, upper 12 and lining 14 are not stitched together. Optionally, upper 12 and lining 14 may be cemented along line 18 if desired to ensure proper positioning.

FIG. 2 illustrates a bottom view of the completed upper, thereby showing the bottom of the sock lining 16 which is to be cemented to the sole.

At this juncture, a last (not shown) is inserted into the shoe. Preferably, the last would be made out of plastic or other materials customarily used for last manufacture. Unlike conventional methods, nothing is attached to the last before it is inserted into the shoe. Note that edge 20 of upper 12 is left free. The next step is to cement sock lining 16 so that it bonds to outer sole 22 on the inside of lip 24 with the last remaining inside the shoe. As noted above, sole 22 is specially designed. Preferably, it is molded polyurethane, however, other materials suitable for shoe construction could be substituted. Note that sole 22 has a recessed lip 24 which provides a glue point of attachment for upper 12. Optionally, lining 14 may be stitched through the outside of lip 24 of outer sole 22 to provide extra strength, if desired. Then, lower edge 20 of upper 12 is cemented to lip 24 and pressed so that a smooth fit is obtained. At this stage, the shoe is placed in a pressure bag which forms the shoe to the last and the last is removed. The shoe is finished. However, sidewall stitching on edge 20 of upper 12 can be added for appearances or extra fastening strength, if desired.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A method of constructing a shoe using a last, said shoe having an upper with a lower edge, vamp and quarter linings, an outer sole with a recessed lip having an inner and outer surface and a sock lining, the method comprising the steps of:

cutting said upper and linings to fit the last;

joining the vamp and quarter linings to the sock lining to form an inner lining;

uniting said inner lining with said upper using cement between said upper and said inner lining wherein said inner lining is positioned with respect to said upper;

forcing the last into said united upper and inner lining, wherein said upper is free from said inner lining at the lower edge of said upper;

fastening said inner lining to said outer sole at least along the inner surface of the recessed lip of said outer sole to form a bond between said inner lining and said outer sole;

cementing the lower edge of said upper to the outer surface of the recessed lip of said outer sole to form a bond between said lower edge of said upper and the outer surface of the recessed lip of said outer sole, thereby forming said shoe;

exposing said shoe to external pressure, such that the bonds are completely set;

removing the last from the completed shoe.

2. The method in claim 1, whereby the step of exposing said shoe to pressure is accomplished by placing said shoe in a pressurized flexible bag.

3. The method in claim 1 comprises the additional step of stitching the lower edge of said upper to the outer surface of the recessed lip of said outer sole.

4. The method of claim 1 wherein said last is free from attachments at the time said last is inserted into said united upper and inner lining.

* * * * *